United States Patent [19]

Battles

[11] 4,229,211

[45] Oct. 21, 1980

[54] LADLE HEATING SYSTEM

[75] Inventor: Donald D. Battles, Atlanta, Ga.

[73] Assignee: The Cadre Corporation, Doraville, Ga.

[21] Appl. No.: 92,374

[22] Filed: Nov. 8, 1979

Related U.S. Application Data

[63] Continuation-in-part of Ser. No. 22,687, Mar. 21, 1979.

[51] Int. Cl.[3] ..... F27B 14/14

[52] U.S. Cl. ..... 75/46; 266/141; 432/225

[58] Field of Search ..... 75/46; 266/141; 432/224, 225

[56] References Cited

U.S. PATENT DOCUMENTS

| | | | |
|---|---|---|---|
| 792,642 | 6/1905 | Williams | 266/141 |
| 2,294,168 | 8/1942 | Francis et al. | 432/224 |
| 3,970,444 | 7/1976 | Brotzmann et al. | 75/46 |

*Primary Examiner*—M. J. Andrews

*Attorney, Agent, or Firm*—Jones, Thomas & Askew

[57] ABSTRACT

Prior to the receipt of a charge of molten metal, a ladle is heated by a direct flame, by applying a seal to the rim of the ladle and directing air through a heat exchanger and to the ladle, mixing fuel with the air and igniting the mixture and directing the flame in to the ladle chamber, and exhausting the gases of combustion from the ladle chamber back through the heat exchanger. The seal applied to the rim of the ladle comprises a network of refractory fiber modules mounted in a common plane. Each module comprises a rectangular block formed of a web of refractory fibers in an accordion folded arrangement, and the modules are mounted with their folded edges exposed, and with the folds of each module extending at right angles with respect to the folds of the adjacent modules.

22 Claims, 8 Drawing Figures

LADLE HEATING SYSTEM

CROSS REFERENCE TO RELATED APPLICATION

This application is a continuation-in-part of U.S. Patent Application Ser. No. 22,687, filed Mar. 21, 1979.

TECHNICAL FIELD

This invention relates to a ladle heating system wherein a flame is directed into the chamber of a ladle and the hot gases are exhausted from the ladle through a heat exchanger which heats the on-coming air and fuel that forms the flame.

BACKGROUND ART

In the ferrous and nonferrous molten metals industries, ladles and similar metal receivers such as holding vessels and vacuum furnace chambers, receive a charge of molten metal. The receivers usually are lined with a refractory material, and it is desirable to preheat the receiver before molten metal is received in the receiver in order to avoid interface solidification of the metal upon contact between the metal and the cold interior surface of the receiver, and also to avoid thermal shock to the refractory liner of the receiver, thus avoiding deterioration of the liner. A preheated ladle also minimizes the heat loss from the molten metal as the metal is transported in the ladle from the furnace to the pouring position, thereby assisting in maintaining the molten metal at a high enough temperature for use in a casting machine or mold.

A common prior art method for heating ladles and other molten metal receivers prior to charging them with molten metal is to direct an open natural gas flame into the open chamber of the ladle. The open flame heating method permits combustion gases from within the ladle chamber to escape to the surrounding atmosphere. This permits a substantial amount of the heat energy to escape without effective use thereof, thus wasting an excessive amount of gas. Moreover, it is difficult to uniformly heat a ladle with an open flame, in that the ladle may be overheated in some areas and not heated sufficiently in other areas. Additionally, after a ladle has been initially heated, it is sometimes desirable to maintain the ladle in its heated condition if the ladle achieves its desired temperature before it is time to introduce the molten metal to the ladle. In this situation the open flame heating procedure continues to waste energy and hot spots are more likely to be formed in the ladle.

SUMMARY OF THE INVENTION

Briefly, described, the present invention comprises an improved system for preheating ladles and similar molten metal receivers wherein a seal is applied to the rim of the ladle and air is directed through a heat exchanger and through the seal and mixed with a fuel to form a flame in the ladle chamber, and the gases from the flame are exhausted back through the seal and through the heat exchanger. The heat in the exhaust gases is partially recouperated in the heat exchanger by being transferred to the oncoming air, and the flame formed in the ladle chamber is controlled so as to wash the inner surfaces of the chamber with heat in a manner that tends to avoid hot and cold spots in the ladle. The exhaust gases are directed through an exhaust opening in the seal which is approximately concentric with the ladle rim, thus further controlling the heat applied to the ladle. The seal formed against the ladle rim comprises a network of refractory fiber modules each formed from a web of refractory fibers, with the webs formed in an accordian fold, and the modules are arranged in a common plane with the folds of each module arranged at a right angle with respect to the folds of the adjacent modules. The refractory fiber modules are maintained in compression by the seal support frame, and when the seal is pressed into abutment with the rim of the ladle, the modules tend to conform to the shape of the ladle rim and form a seal about the rim. The ability of the seal to be compressed tends to compensate for irregularities of the ladle rim as might be caused by a build up of slag or by chips or rough surfaces present on the ladle rim.

The heat exchanger is shielded from direct radiation from the flame in the ladle chamber, and the heat exchanger can comprise a multiple stage heat exchanger with the first exchanger that receives the hottest gases being fabricated of a material with a superior heat resistance than the subsequent ones of the heat exchangers.

Thus, it is an object of this invention to provide a heating system which efficiently heats ladles and other chambers with a flame in a controlled environment.

Another object of this invention is to provide a ladle heating system with an improved seal assembly which is effective to form a seal about the rims of ladles of different sizes and shapes and which compensates for the build up of slag on the rim of the ladle and for chips, cracks or other imperfections present in the rim of the ladle and avoids the dissemination of noise because of escaping gases or "stingers" from between the ladle rim and the seal assembly.

Another object of this invention is to provide a ladle heating system that is inexpensive to construct and to operate, which conserves energy and which is durable and easy to repair.

Other objects, features and advantages of the present invention will become apparent upon reading the following specfication, when taken in conjunction with the accompanying drawings.

DETAILED DESCRIPTION

Figure 1:
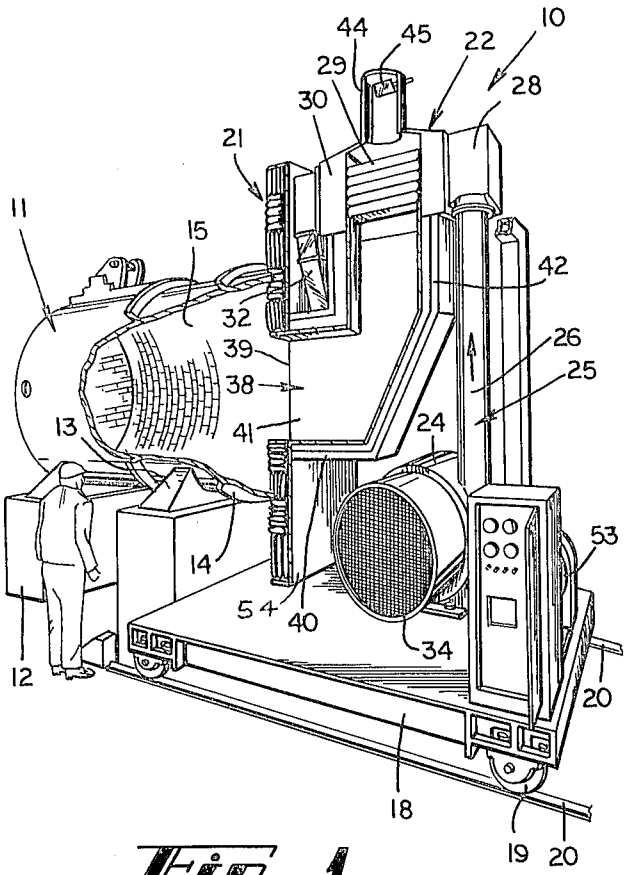
FIG. 1 is a perspective illustration of a ladle and the ladle heater, with portions removed to illustrate the inside of the ladle and the ladle heater.

Referring now in more detail to the drawings, in which like numerals indicate like parts throughout the several views, FIG. 1 illustrates the ladle heater 10 for heating ladles such as ladle 11. The ladle 11 is illustrated as resting on its side on support blocks 12 and shims 13, with its rim 14 facing to the side. The ladle 11 includes a chamber 15 lined with fire brick or other suitable heat resistant material. The rim 14 typically is circular in shape but can include a pouring spout or other noncircular shapes. In some instances a build up of slag is present on the rim 14 of the ladle, or the ladle rim may be chipped or cracked or otherwise imperfect in shape.

Ladle heater 10 includes a carriage 18 mounted on wheels 19 and the wheels are movable along tracks 20. Seal assembly 21 is mounted on carriage 18, a heat exchanger 22 is also mounted on carriage 18, blower 24 is mounted on carriage 18, and air conduit means 25 includes blower exhaust duct 26 which extends upwardly from blower 24, heat exchanger header 28 on one side of the heat exchanger tubes 29, a second heat exchanger header 30 positioned on the other side of the heat exchange tubes 29, and branch conduit 31 and 32 extending downwardly from header 29 and turning inwardly through seal assembly 21. Burners 35 and 36 communicate with the air conduit means 25 at the intersection of the branch conduits 31 and 32 with the seal assembly 21. A filter 34 is mounted on the inlet of blower 24.

An exhaust gas conduit means 28 defines an opening 39 through seal assembly 21 between burners 35 and 36 and duct work 40 that extends first in a horizontal leg 41 from opening 39 and then in a vertical leg 42 upwardly to heat exchanger 22, and then an exhaust duct 44 extends upwardly from the heat exchanger and directs the exhaust gases away from the ladle heater. A damper 45 is located in exhaust duct 44 and is arranged to selectively block or restrict the movement of gases through the exhaust gas conduit means. It will be noted that the heat exchanger 22 is remotely located from opening 39 of exhaust gas conduit means 38 whereby the flames in the chamber 15 of ladle 11 do not directly radiate heat to the heat exchanger. Also, the duct work 40 of the exhaust gas conduit means is heat insulated. The framework 46 is mounted on carriage 18 and includes various upright, horizontal and diagonal support beams for supporting the seal assembly 21, heat exchanger 22 and air conduit means and exhaust gas conduit means and their related components.

Figure 2:
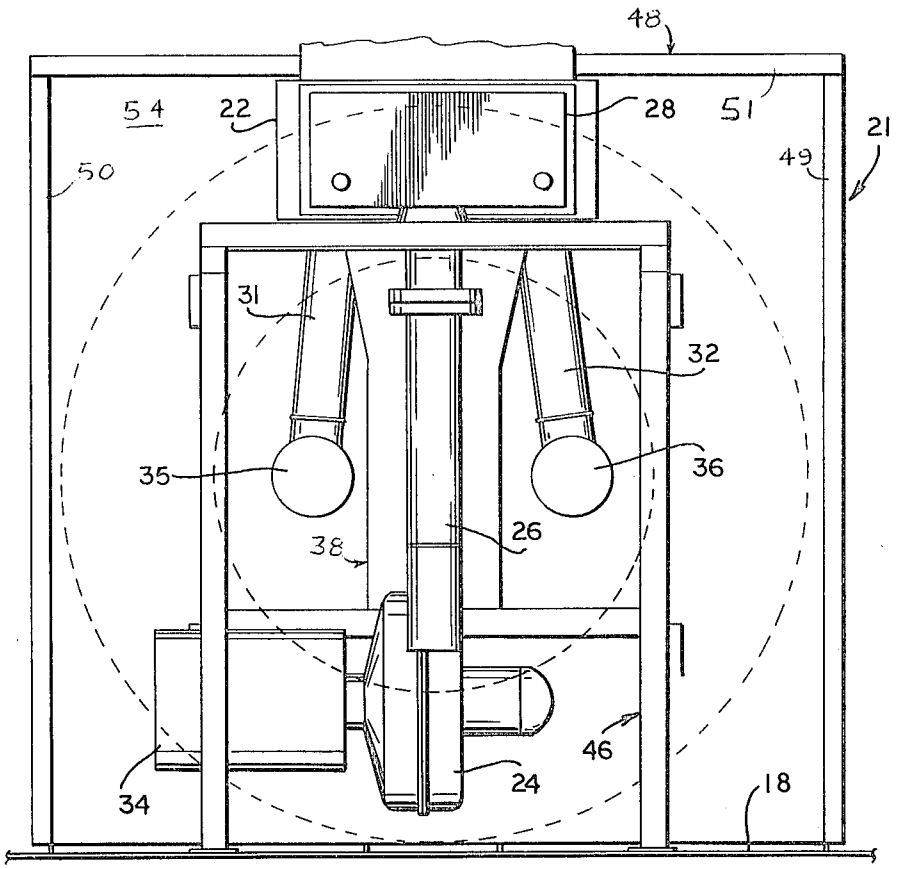
FIG. 2 is a back view of the ladle heater, with the carriage removed.
Figure 3:
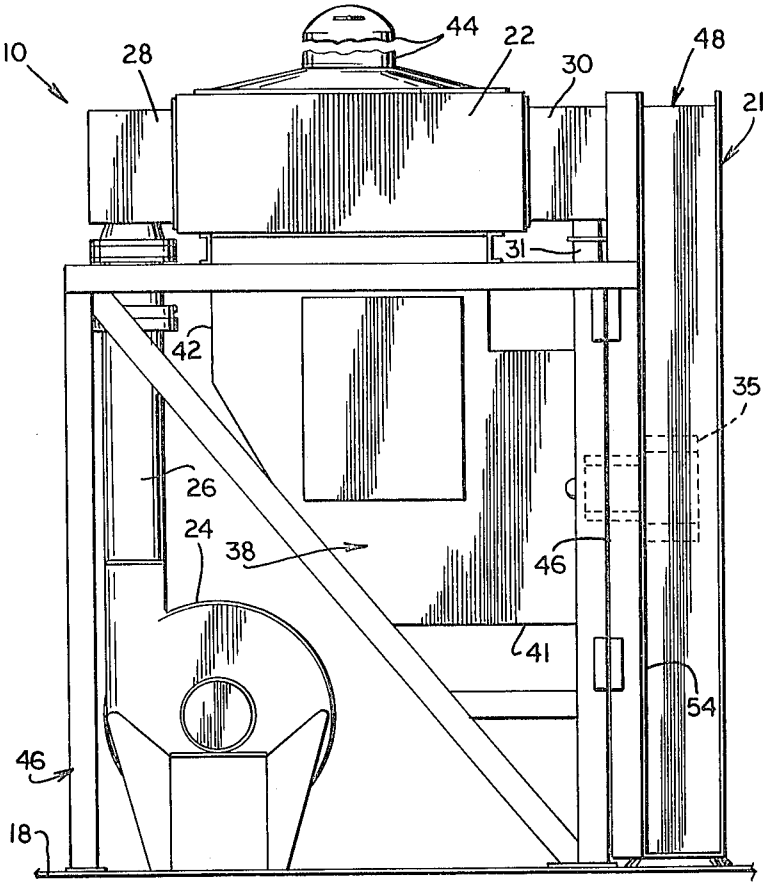
FIG. 3 is a side elevational view of the ladle heater, with the carriage removed.

As illustrated in FIGS. 2 and 3, seal assembly 21 comprises a support frame 48 that includes upright side frame elements 49 and 50, upper horizontal frame element 51 and lower horizontal frame element 52. Upright steel support plate 54 has its edges in abutment with frame elements 49–52. Frame elements 49–52 are channel members, each have one flange in abutment with the upright steel plate 54 and the outer flanges thereof located in a common plane and forming a frame rim. A network of refactory fiber modules or insulating blocks 55 are mounted in support frame 48, forming a surface of refactory fibers inside the frame elements. The refactory fiber modules 55 that are adjacent frame elements 49–52 are partially confined in the flanges of the channel shaped beams 49–52, and each module 55 is attached to upright steel support plate 54.

Each refactory fiber module or batt 55 (FIG. 5) is formed from a web or blanket of refactory fibers, and the webs are in the form of elongated sheets. The sheets are folded in a zig-zag or an accordion arrangement so as to include a series of layers 56 with exposed side edged 58 and folds 59 on a front surface and similar folds 60 on the back surface of the modules. The modules 55 are rectangular in shape and are each maintained in their accordion folded configuration by bands wrapped around the module until the modules are mounted in the support frame 48, whereupon the bands are removed. The bands tend to hold the modules in compression until the bands are removed. The modules each include support rods 61 extending between the layers 56 at the folds 60 at the back surface of the module with connecting tabs 62 extending therefrom and projecting through the blanket at a fold 60. A channel-shaped connector bracket 63 defines slots therethrough for receiving the tabs 62 of the support rods and when the tabs are inserted through an opening they are bent so that the bracket 63 is secured to the module. The channel of the channel-shaped bracket is then attached to a projection 64 mounted on the upright support plate 54 to secure the module to the support frame 48. A more detailed description of a similar insulating block is found in U.S. Pat. No. 4,001,996.

The modules 55 are packed within the confines of the support frame. After they have been properly positioned and packed in the support frame, their straps (not shown) are removed, and the modules tend to remain in compression due to their abutment with one another. It will be noted that the folds 59 of each module 55 are oriented at a right angle with respect to the folds of the next adjacent modules. Thus, a parket or alternating fold effect is created across the network of the seal assembly. The layers 56 are each approximately cube-shaped and are, in the disclosed embodiment, approximately one foot square. However, other dimensions and other shapes can be utilized if desired.

Figure 5:
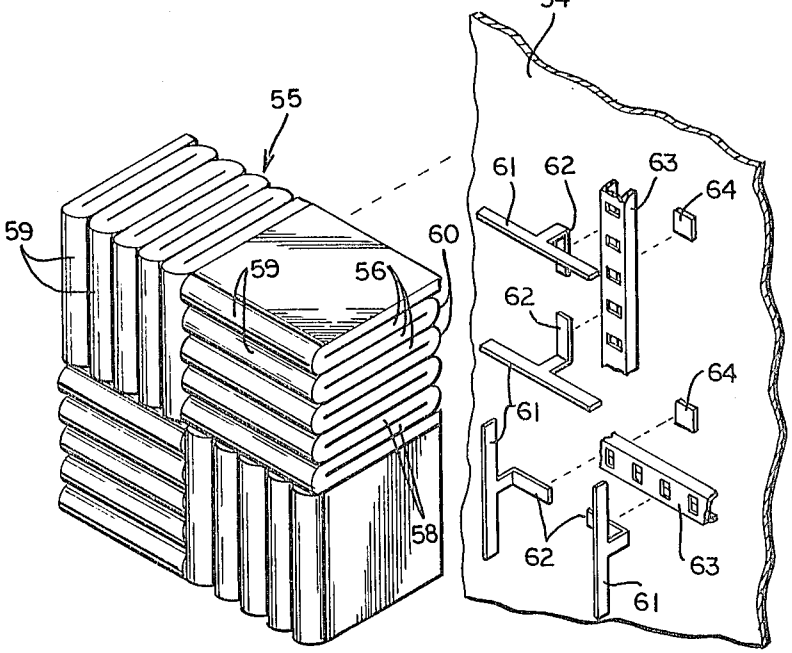
FIG. 5 is a detailed exploded perspective illustration of several of the refractory fiber modules and the upright seal support plate.

When the ladle heater 10 and a ladle 11 are moved into engagement with each other as shown in FIG. 1, the rim 14 of the ladle moves into abutment with the seal assembly 21. Since the seal assembly 21 includes a network of refactory fiber modules 55 each formed in an accordion arrangement as illustrated in FIG. 5, the rim 14 tends to penetrate or move into the surface of the seal assembly formed by the folds 59 of the refactory fiber webs. As the rim is forced against the modules 55, an indentation is made in the refactory fibers. The rim and seal assembly are moved together with a force in excess of 2 pounds per square inch, preferrably with a force between 4 and 10 pounds per square inch, so that the rim tends to penetrate the surface of the seal assembly and a good seal is made about the ladle rim. The desired depth of indentation in the seal assembly is about 3 inches. The density of the refactory fiber modules is approximately 8 pounds per square inch. Thus, a firm seal is made about the ladle rim 14 and a substantial thickness of the refactory fiber material remains between the ladle rim and the upright steel plate 54 which supports the fiber modules 55.

Those modules 55 that are not directly engaged by the rim of the ladle remain uncompressed by the rim and tend to retain all of their heat resistance characteristics, thus closing off the ladle opening inside the rim of the ladle, so that the seal assembly functions as a lid or closure wall with respect to the chamber 15 of the ladle except for exhaust opening 39, and the openings through which the burners 35 and 36 and temperature probes or other elements project. By this arrangement the refractory fiber web material of the modules 55 shields the other components of the ladle heater from direct heat radiation from the flame inside the ladle.

Preferrably, the ladle 11 and the seal assembly 21 will be positioned so that the opening 39 of the exhaust gas conduit means 38 is coaxially positioned with respect to the rim 14, thereby directing the exhaust gases out of the chamber 15 of the ladle through the middle of the opening formed by the ladle rim 14. Since the burners 35 and 36 are located on opposite sides of opening 39, the flames will be projected into the chamber on opposite sides of the exhaust opening 39. Preferrably the burners 35 and 36 are constructed and arranged to direct the flames toward the central portion of the bottom of the ladle chamber 15, with the flames merging with each other at the bottom wall of the ladle, thus tending to completely wash the bottom surface of the ladle with flame. This tends to apply the hottest heat to the thicker bottom wall of the ladle, and the flame and gases of combustion tend to wash back along the annular side wall of the ladle and ultimately exit through the exhaust opening 39 and on through the exhaust gas conduit means 38. This tends to uniformly heat the ladle and the heat not transferred from the flame and gasses to the ladle is moved with the gasses through exhaust opening 39.

Reversible Motor 53 is mounted on carriage 18 and is in driving relationship with respect to the wheels 19 of the platform and thus functions as a means for urging the seal assembly and the rim of the ladle in compressive relationship with respect to each other.

Heat exchanger 22 is located at the upper portion of the ladle heater 10 where it is accessible for inspection and repair. This location of the heat exchanger also places it in a remote location with respect to the flame applied within the chamber 15 of the ladle 11, so that the heat exchanger is not in direct heat radiation with respect to the flame in the chamber. This protects the heat exchanger from the additional heat of radiation, while the heat exchanger is fully exposed to the heat of convection from the exhaust gases moving through the exhaust gas conduit means. The heat exchanger 22 is fabricated from ceramic materials so that it is capable of withstanding temperatures in excess of 2000° F.

When the heating of the ladle has been accomplished by the ladle heater 10, the usual procedure is to extinguish the flame within the chamber 15 of the ladle by terminating the flow of fuel and air to the burners 35 and 36, to close damper 45 in the exhaust duct 44 and to move the ladle 11 and ladle heater 10 apart, whereupon the ladle can be turned to an upright attitude and transported to a position for filling with molten metal, etc. When the damper 45 is closed, atmospheric air is substantially prevented from flowing through exhaust gas conduit means 38 and through heat exchanger 22. This avoids rapid cooling of the heat exchanger 22, and thereby reduces the hazard of damage to the heat exchanger due to rapid contraction. Also, if the ladle heater 10 is to be used again within a short period, the heat exchanger 22 will retain a substantial amount of its heat for its next cycle of operation.

Figure 6:
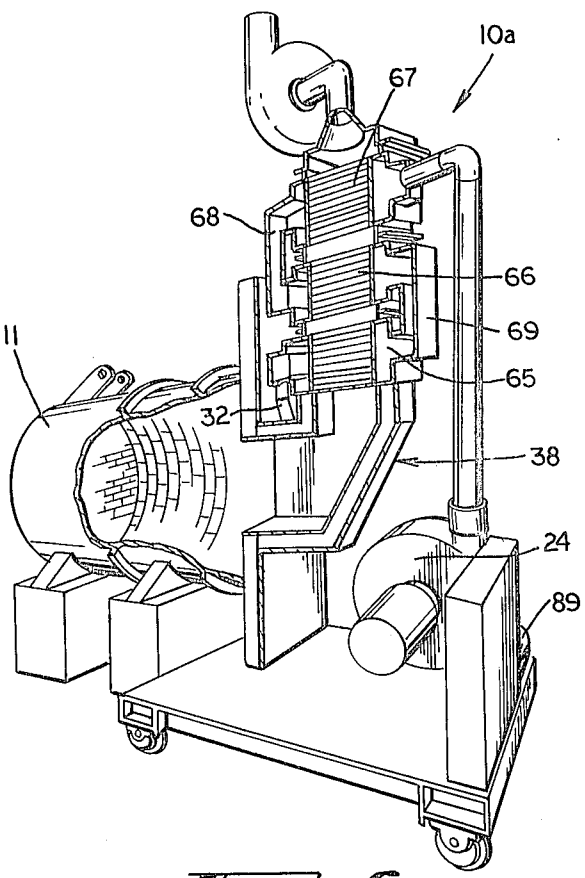
FIG. 6 is a perspective illustration, similar to FIG. 1, but illustrating a second embodiment of the ladle heater.

As illustrated in FIG. 6, wherein a second embodiment of the invention is disclosed, the heat exchanger can be formed as a multiple stage heat exchanger wherein a first stage 65 is located relatively low in the exhaust gas conduit means 38 and one or more additional heat exchangers are located in sequence therewith. In the embodyment illustrated, an intermediate or second stage heat exchanger 66 is located above the first stage heat exchanger, and an upper or third stage heater exchanger 67 is located above second stage heat exchanger 66. The exhaust gases are directed in sequence through the first, second and third heat exchanger, with the first stage 65 receiving the hottest gases of combustion. The air from blower 24 passes first through the upper or third stage heat exchanger 67, then through duct 68 to the second stage heat exchanger 66, then through duct 69 through the first stage heat exchanger 65, and then through branch conduits 31 and 32 to the burners 35 and 36. Exhaust blower 24A is located above third stage heat exchangers 67 and induces a flow of hot gases from the ladle across the heat exchangers.

Preferrably, first stage heat exchanger 65 is fabricated from ceramic materials which are capable of withstanding temperatures in excess of 2000° F. The second and/or third heat exchangers 66 and 67 are fabricated from stainless steel and carbon steel respectively which are materials which are not capable of withstanding the high temperatures that the ceramic materials can withstand. For example, the ceramic heat exchanger is fabricated to withstand temperatures up to 2600° F., the stainless steel heat exchanger is fabricated to withstand temperatures up to 1800° F. and the carbon steel heat exchanger is fabricated to withstand temperatures up to 1000° F. It is anticipated that the temperature of the gases exhausted from the third stage heat exchanger will be approximately 600° F. The air moved from blower 24 is expected to be received in third stage heat exchanger 67 at a temperature of approximately 100° F., will exit from the third stage heat exchanger and enter the second stage heat exchanger 66 at a temperature of approximately 500° F., and will exit from the second stage heat exchanger 66 and enter first stage heat exchanger 65 at a temperature at approximately 1300° F. The temperature of the air as it leaves the first stage heat exchanger 65 and approaches the burners will be approximately 2000° F. While specific materials are disclosed from which the heat exchangers can be fabricated, other materials can be used and different sizes, types and numbers of heat exchangers can be utilized, if desired.

Figure 7:
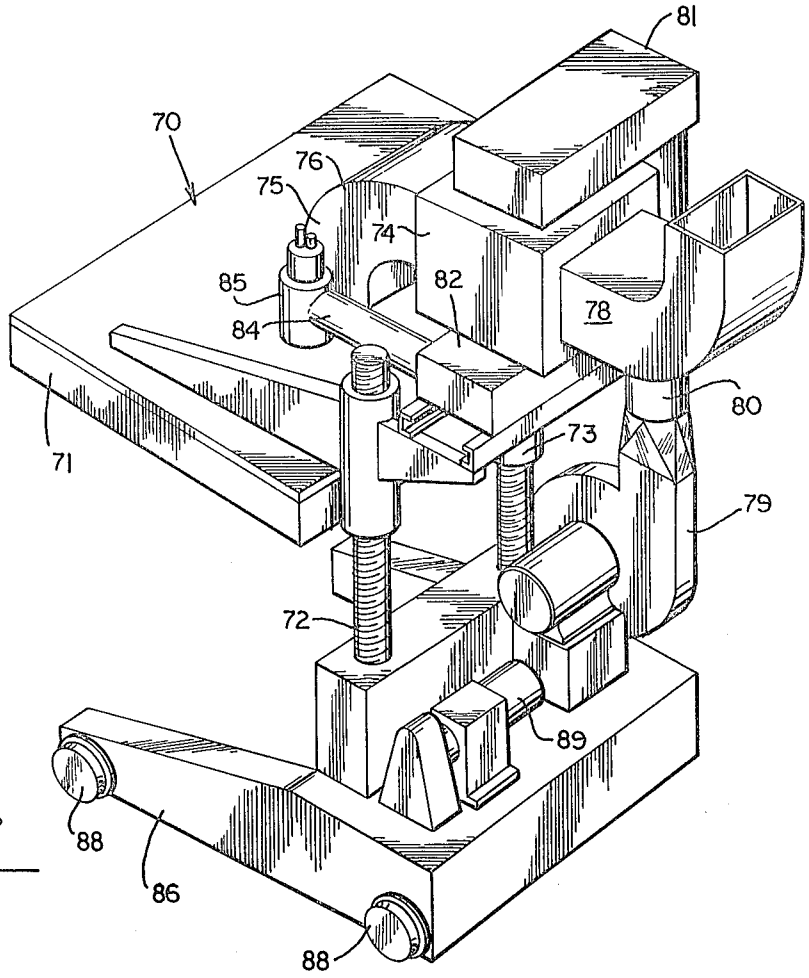
FIG. 7 is a perspective illustration of a third embodiment of the ladle heater.
Figure 4:
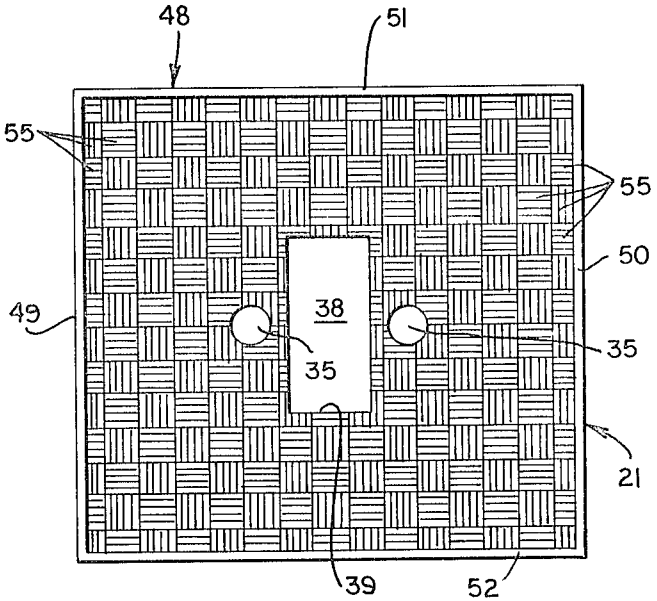
FIG. 4 is a front elevational view of the ladle heater, with the carriage removed, showing the face of the seal assembly.

As illustrated in FIG. 7, the seal assembly of the ladle heater can be reoriented from a vertical attitude to a horizontal attitude to engage the rim of an upright ladle. Seal assembly 70 comprises a support frame 71 and a network of refactory fiber modules (not shown) similar to those illustrated in FIGS. 4 and 5 are supported in the horizontal support frame. The support frame is movably mounted on upright threaded jack screws 72 and 73 and the exhaust gas conduit means 75 comprises duct work 76 that extends from the opening (not shown) in the seal assembly 70 to the next exchanger 74, and exhaust duct 78 directs the exhaust gases from the heat exchanger 74 away from the ladle heater. Blower 79 directs air through conduit 80 to the upper header 81 of the heat exchanger, and the air is than directed down through the heat exchanger 74, lower header 82 and then through branch conduits such as conduit 84 to burners such as burner 85. The ladle heater of FIG. 7 is mounted on a carriage 86 and carriage 86 is mounted on wheels 88 for movement along a track or the like. The reversible motor 89 is mounted on platform 18 and is arranged to drive the wheels of the ladle heater so that the ladle heater can be moved along the tracks 20 toward or away from a ladle. In the alternative, the ladle heater of FIG. 7 can be mounted in a stationary position if desired. The jack screws function as a means for urging the seal assembly and the rim of the ladle in compressive relationship with respect to each other.

Figure 8:
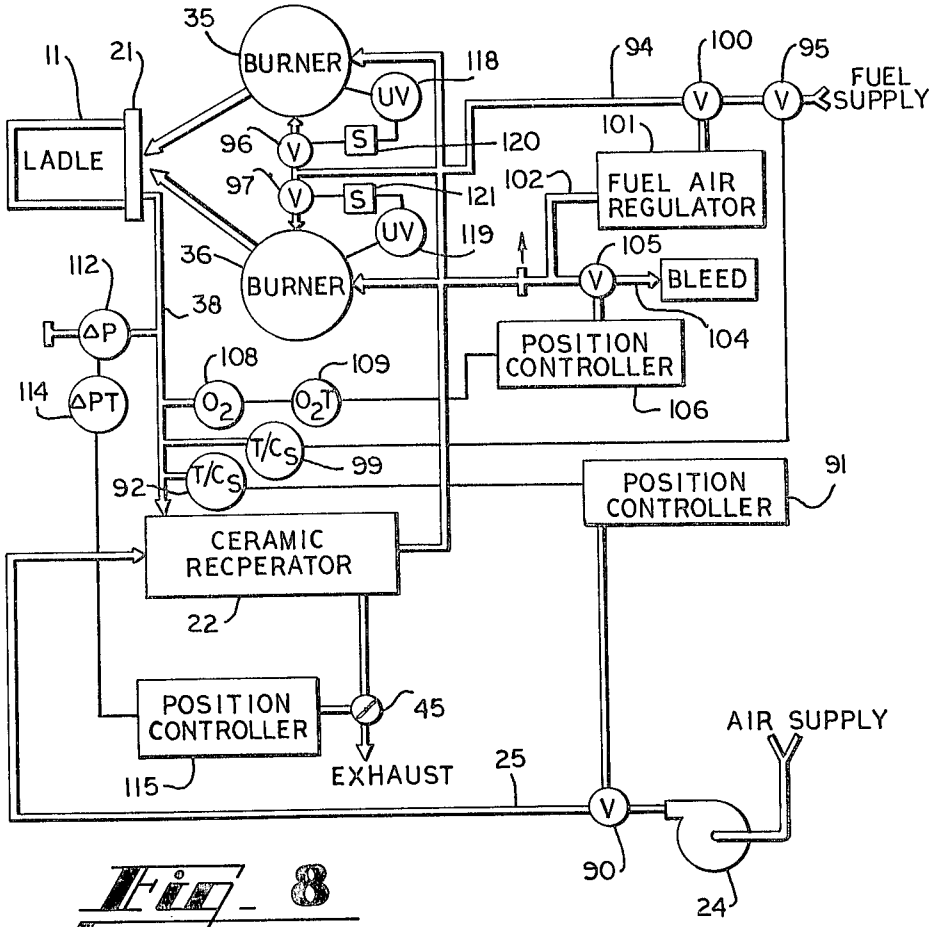
FIG. 8 is a schematic illustration of the control system for controlling the operation of the ladle heater.

As illustrated in FIG. 8, a control system is provided for controlling the operation of the ladle heater illustrated in FIGS. 1–4. Similar control systems are provided for ladle heaters of the type illustrated in FIGS. 6 and 7. Air is directed from blower 24 through the air conduit means 25, through heat exchanger 22 and to burners 35 and 36 and through seal assembly 21 to the ladle 11. Air control valve 90 regulates the flow of air from blower 24 through the air conduit means, and position controller 91 controls the position valve 90. Position controller 91 is acuated by thermocouple 92 which detects the temperature of the exhaust gases moving through exhaust gas conduit means 38. Thus, when the temperature of the exhaust gases is higher than desired, position controller 91 and air control valve 90 function to reduce the amount of air moving to the ladle.

Fuel is directed through fuel line 94 from a supply under pressure and passes through high temperature shutoff valve 95 and flame out safety shut off solnoid valves 96 and 97 to burners 35 and 36. Thermocouple 99 senses the temperature of the exhaust gases flowing through exhaust gas conduit means 38 and regulates shutoff valve 95. For example, when the temperature of exhaust gases is too high, valve 95 is closed and the flames from both burners 35 and 36 are extinguish. Fuel regulator valve 100 is also positioned in fuel line 94. Fuel/air regulator 101 regulates the fuel valve 100, and its sensing conduit 102 communicates with air supply conduit means 25. Sensing conduit 102 includes a bleed line 104, and valve 105 regulates the bleed through bleed line 104. Position controller 106 regulates bleed valve 105, and position controller 106 is regulated by oxygen sensor 108 and by oxygen transmitter 109. When an excessive amount of oxygen is detected in exhaust gas conduit means 38, oxygen transmitter 109 causes position controller 106 to close valve 105, causing fuel air regulator 101 to further open fuel valve 100. This supplies additional fuel to burners 35 and 36, thus tending to provide sufficient fuel to complete the combustion of the oxygen supplied by the air to the ladle.

When the seal assembly 21 and ladle 11 are separated, differential pressure sensor 112 detects a change in pressure in exhaust gas conduit means 38, and differential pressure transmitter 114 activates position controller 115 to close exhaust damper 45, to prevent atmospheric air from passing through heat exchanger 22.

Ultraviolet sensors 118 and 119 are mounted on each burner 35 and 36 and each functions to acuate its solinoid valve 120 or 121 in response to a flame out in its burner, thus immediately terminating the flow of fuel to its burner.

Although the foregoing description relates to apparatus and methods of heating ladles, it should be understood that various other objects can be heated with the disclosed apparatus and method. It should be understood, of course, that the foregoing relates only to preferred embodiments of the present invention and that numerous modifications or alternations may be made therein without departing from the spirit and the scope of the invention as set forth in the appended claims.

I claim:

1. Apparatus for heating a ladle or the like which includes a chamber with an opening and a rim about the opening, said apparatus comprising a seal assembly for sealing engagement with the rim of the ladle, said seal assembly comprising a support frame of greater breadth than the rim of the ladle, a plurality of refractory fiber modules mounted on said support frame approximately in a common plane, each said module being compressible and held in lateral compression by said frame and by lateral engagement with one another and said plurality of modules positioned on said support frame to sealingly engage the rim of the ladle, a heat exchanger mounted adjacent said seal assembly, air conduit means extending through said heat exchanger and through said seal assembly for directing air through the heat exchanger, through said seal assembly and into the ladle in sealing engagement with the seal assembly, an exhaust gas conduit means extending through said seal assembly and through said heat exchanger for directing exhaust gases from the ladle in sealing engagement with said seal assembly through said seal assembly and through said heat exchanger, blower means for inducing a stream of air through said air conduit means and a stream of exhaust gases through said exhaust gas conduit means, burner means for supplying fuel to said air conduit means and for directing a flame into the ladle in sealing engagement with said seal assembly.

2. The apparatus of claim 1 and wherein said exhaust gas conduit means includes a single opening through said seal assembly, and wherein said air conduit means comprises openings through said seal assembly on opposite sides of the exhaust gas opening, and burner means for supplying fuel at each air conduit opening.

3. The apparatus of claim 2 and wherein said air conduit openings and said burner means are constructed and arranged to direct flames into the ladle chamber toward the surface of the ladle opposite to the rim of the ladle.

4. The apparatus of claim 1 and wherein said seal assembly, said exhaust gas conduit means and said heat exchanger are constructed and arranged so that the flames present in the chamber of the ladle are substantially shielded from direct radiation to said heat exchanger.

5. The apparatus of claim 1 and wherein said refractory fiber modules each comprises a web of material with the web formed in a zig-zag arrangement with parallel overlying layers, with the layers of each module extending generally toward the position of the ladle so that the rim of the ladle can compress the layers along their lengths.

6. The apparatus of claim 5 and wherein the layers of the modules are oriented at right angles with respect to the layers of the next adjacent module.

7. The apparatus of claim 1 and further including means for urging said seal assembly and the rim of the ladle into compressive engagement with each other.

8. The apparatus of claim 1 and wherein said support frame includes an outer support flange surrounding said refractory fiber modules for supporting said fiber modules in compression against one another.

9. The apparatus of claim 1 and wherein said heat exchanger comprises a plurality of heat exchangers, and wherein said air conduit means extends in series through said heat exchangers, and wherein said exhaust gas conduit extends in series through said heat exchangers.

10. The apparatus of claim 9 and wherein the heat exchanger to which the exhaust gases are first directed is a ceramic heat exchanger.

11. The apparatus of claim 1 and wherein the refractory fiber modules of said seal assembly are supported by said support frame in an approximately upright plane, and further comprising means for moving said seal assembly toward and away from the rim of a ladle.

12. The apparatus of claim 1 and wherein the refractory fiber modules of said seal assembly are supported by said support frame in an approximately horizontal attitude, and further comprising means for raising and lowering said seal assembly toward and away from the rim of a ladle.

13. The apparatus of claim 1 and further including a damper means in said exhaust gas conduit means for restricting the movement of gas through said exhaust gas conduit means.

14. A method of heating ladles or the like comprising engaging the rim of the ladle with a seal of refractory fiber modules positioned substantially in a common plane with sufficient force to cause the rim of the ladle to be pressed into the seal and compress the fibers of the modules it enages, directing air through a heat exchanger and through the seal into the ladle, mixing fuel with the air and igniting the mixture as the mixture passes through the seal and into the ladle, and exhausting the gases from the ladle through the seal and through the heat exchanger.

15. The method of claim 14 and wherein the step of exhausting the gases from the ladle through the seal and through the heat exchanger comprises exhausting the gases through a plurality of heat exchangers arranged in series.

16. The method of claim 14 and wherein the step of exhausting the gases of the ladle through the seal and through the heat exchanger comprises exhausting the gases through a heat exchanger out of direct radiation with respect to the flame in the ladle.

17. The method of claim 14 and after a ladle has been heated further including the steps of blocking the exhaust of gases through the heat exchanger and disengaging the rim of the ladle and the seal.

18. The method of claim 14 and wherein the step of engaging the rim of the ladle with a seal of refractory fiber modules comprises substantially closing the opening of the ladle formed by the rim of the ladle.

19. In combination with apparatus for heating ladles or the like, a seal assembly for sealing abutment with the rim of a ladle, said seal assembly comprising a support frame, a network of refractory fiber modules supported by said support frame in a common plane, each of said modules being held by the others of the modules and by said support frame in compression across the common plane.

20. The combination of claim 19 and wherein each refractory fiber module comprises a web of refractory fibers formed in a flat elongated sheet with the sheet arranged in overlying zig-zag folds in a block of folds with the folds of the block exposed at opposite sides of the block, and wherein said support frame supports the modules with the folds on one side thereof in substantially a common plane and with the folds of each module extending at a right angle with respect to the folds of the next adjacent module.

21. In combination with apparatus for heating ladles or the like, a seal assembly for movement into sealing abutment with the rim of the ladle, said seal assembly comprising a support frame and a layer of compressible refractory fiber material supported by said support frame and arranged in a configuration to engage the rim of the ladle and form a seal about the rim of the ladle.

22. The combination of claim 21 and wherein said layer of compressible refractory material comprises a blanket of material folded in an accordion arrangement with the folds of the blanket exposed to engage the rim of the ladle.

* * * * *

Disclaimer 4,229,211.—*Donald D. Battles*, Atlanta, Ga. LADLE HEATING SYSTEM. Patent dated Oct. 21, 1980. Disclaimer filed Oct. 2, 1980, by the assignee, *The Cadre Corporation.*

The term of this patent subsequent to Sept. 22, 1997, has been disclaimed.

[*Official Gazette December 23, 1980*]

REEXAMINATION CERTIFICATE (125th)

United States Patent [19]

Battles

[11] B1 4,229,211

[45] Certificate Issued * Oct. 4, 9183 1983

[54] LADLE HEATING SYSTEM

[75] Inventor: Donald D. Battles, Atlanta, Ga.

[73] Assignee: The Cadre Corporation, Doraville, Ga.

Reexamination Request:
No. 90/000,274, Oct. 19, 1982

Reexamination Certificate for:

| | |
|---|---|
| Patent No.: | **4,229,211** |
| Issued: | **Oct. 21, 1980** |
| Appl. No.: | **92,374** |
| Filed: | **Nov. 8, 1979** |

[ * ] Notice: The portion of the term of this patent subsequent to Sep. 22, 1997 has been disclaimed.

Related U.S. Application Data

[63] Continuation-in-part of Ser. No. 22,687, Mar. 21, 1979, Pat. No. 4,229,211.

[51] Int. Cl.[3] ..... F27B 14/14

[52] U.S. Cl. ..... 266/44; 75/46; 266/141; 266/281; 266/901; 432/9; 432/10; 432/224; 432/225

[58] Field of Search ..... 266/44, 287, 141, 281, 266/901; 75/46; 432/225, 9, 10, 224

[56] References Cited

U.S. PATENT DOCUMENTS

| | | | |
|---|---|---|---|
| 792,642 | 6/1905 | Williams | 266/141 |
| 1,057,905 | 4/1913 | Widekind | 432/224 |
| 1,675,735 | 7/1928 | Stohr . | |
| 2,294,168 | 8/1942 | Francis et al. | 432/224 |
| 3,148,272 | 9/1964 | Aitken et al. | 219/537 |
| 3,890,090 | 6/1975 | Sanderson | 432/250 |
| 3,970,444 | 7/1976 | Brotzmann et al. | 75/46 |
| 4,001,996 | 1/1977 | Byrd, Jr. | 52/509 |
| 4,090,054 | 5/1978 | Heine et al. | 219/10.49 R |
| 4,106,755 | 8/1978 | Dell | 266/44 |
| 4,190,235 | 2/1980 | Dell | 266/44 |

FOREIGN PATENT DOCUMENTS

| | | |
|---|---|---|
| 2623545 | 1/1977 | Fed. Rep. of Germany . |
| 2377595 | 8/1978 | France . |
| 464328 | 5/1926 | Fed. Rep. of Germany . |
| 463090 | 7/1928 | Fed. Rep. of Germany . |
| 375924 | of 1975 | Sweden . |
| 408276 | of 1979 | Sweden . |
| 408277 | of 1979 | Sweden . |
| 976426 | 11/1964 | United Kingdom . |
| 1411277 | of 1975 | United Kingdom . |
| 1510551 | of 1978 | United Kingdom . |
| 1551567 | of 1979 | United Kingdom . |
| 1556617 | of 1979 | United Kingdom . |
| 2005393 | 4/1979 | United Kingdom . |
| 2007342 | 5/1979 | United Kingdom . |
| 1562555 | of 1980 | United Kingdom . |
| 476084 | 4/1974 | U.S.S.R. . |

*Primary Examiner*—Melvyn J. Andrews

[57] ABSTRACT

Prior to the receipt of a charge of molten metal, a ladle is heated by a direct flame, by applying a seal to the rim of the ladle and directing air through a heat exchanger and to the ladle, mixing fuel with the air and igniting the mixture and directing the flame into the ladle chamber, and exhausting the gases of combustion from the ladle chamber back through the heat exchanger. The seal applied to the rim of the ladle comprises a network of refractory fiber modules mounted in a common plane. Each module comprises a rectangular block formed of a web of refractory fibers in an accordion folded arrangement, and the modules are mounted with their folded edges exposed, and with the folds of each module extending at right angles with respect to the folds of the adjacent modules.

REEXAMINATION CERTIFICATE ISSUED UNDER 35 U.S.C. 307.

LADLE HEATING SYSTEM

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–20 is confirmed.

Claim 21 is determined to be patentable as amended:

Claim 22 dependent on an amended claim, is determined to be patentable.

21. In a combination with apparatus for heating ladles or the like, a seal assembly for movement into sealing abutment with the rim of *a* [the] ladle, said seal assembly comprising a support frame and a layer of compressible refractory fiber material supported by said support frame and arranged in a configuration to engage the rim of the ladle and form a seal about the rim of the ladle, *duct means extending through said compressible refractory fiber material for exhausting gases from the ladle, and a burner mounted to said seal assembly for directing a flame into the ladle, whereby the fiber material of the seal assembly can form a seal about the rims of ladles of different sizes and shapes and compensate for the build up of slag on the rims of the ladles and for chips or cracks in the rims of the ladles.*

* * * * *